US005902354A

United States Patent [19]

Polotti et al.

[11] Patent Number: 5,902,354

[45] **Date of Patent: *May 11, 1999**

[54] BLEACHING COMPOSITIONS

[75] Inventors: Gianmarco Polotti, Milan; Stefano Scialla; Raffaele Scoccianti, both of Rome, all of Italy

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/722,038

[22] PCT Filed: Mar. 30, 1995

[86] PCT No.: PCT/US95/04020

§ 371 Date: Mar. 11, 1997

§ 102(e) Date: Mar. 11, 1997

[87] PCT Pub. No.: WO95/27776

PCT Pub. Date: Oct. 19, 1995

[30] Foreign Application Priority Data

Apr. 12, 1994 [EP] European Pat. Off. ..... 94870065

[51] Int. Cl.[6] ..... C11D 3/395; C11D 7/54; C11D 1/02; C11D 1/83

[52] U.S. Cl. ..... 8/111; 510/284; 510/312; 510/375; 510/417; 252/186.38

[58] Field of Search ..... 510/372, 375, 510/376, 309, 284, 312, 417; 252/186.41, 186.43, 186.38; 8/111

[56] References Cited

U.S. PATENT DOCUMENTS

| | | | |
|---|---|---|---|
| 3,652,420 | 3/1972 | Hill | 252/101 |
| 3,655,566 | 4/1972 | Robinson et al. | 252/95 |
| 4,146,499 | 3/1979 | Rosano | 252/186 |
| 4,430,236 | 2/1984 | Franks | 252/95 |
| 4,472,291 | 9/1984 | Rosano | 252/186.28 |
| 4,496,473 | 1/1985 | Sanderson | 252/186.41 |
| 4,541,944 | 9/1985 | Sanderson | 252/95 |
| 4,613,452 | 9/1986 | Sanderson | 252/186.23 |
| 4,828,747 | 5/1989 | Rerek et al. | 252/95 |
| 5,118,436 | 6/1992 | Aoyagi et al. | 252/99 |
| 5,141,664 | 8/1992 | Corring et al. | 252/90 |
| 5,236,614 | 8/1993 | Jacquet et al. | 252/96 |
| 5,338,475 | 8/1994 | Corey et al. | 252/102 |
| 5,409,632 | 4/1995 | Showell et al. | 252/186 |
| 5,429,769 | 7/1995 | Nicholson et al. | 252/186.42 |
| 5,575,948 | 11/1996 | Petchul et al. | 252/186.28 |
| 5,576,282 | 11/1996 | Miracle et al. | 510/276 |
| 5,580,485 | 12/1996 | Feringa et al. | 510/311 |
| 5,656,280 | 8/1997 | Herb et al. | 424/401 |
| 5,700,771 | 12/1997 | Hardy et al. | 510/315 |
| 5,713,962 | 2/1998 | Scialla et al. | 8/111 |
| 5,759,989 | 6/1998 | Scialla et al. | 510/500 |

FOREIGN PATENT DOCUMENTS

| | | | |
|---|---|---|---|
| 92 932 | 2/1983 | European Pat. Off. . | |
| 0 092 932 A1 | 11/1983 | European Pat. Off. | C11D 3/39 |
| 125 781 | 11/1984 | European Pat. Off. | C11D 3/39 |
| 598170 | 5/1994 | European Pat. Off. | C11D 3/39 |
| 598692 | 5/1994 | European Pat. Off. | C11D 17/00 |
| 598973 | 6/1994 | European Pat. Off. | C11D 1/825 |
| 629690 | 12/1994 | European Pat. Off. | C11D 1/825 |
| 634476 | 1/1995 | European Pat. Off. | C11D 3/28 |
| 686691 | 12/1995 | European Pat. Off. | C11D 1/825 |
| 39 14 336 | 10/1990 | Germany . | |
| WO 93/12067 | 12/1991 | WIPO | C07C 69/66 |

*Primary Examiner*—Paul Lieberman
*Assistant Examiner*—John M. Petruncio
*Attorney, Agent, or Firm*—Robert B. Aylor

[57] ABSTRACT

The use of anionic surfactants in a liquid peroxygen bleaching composition disclosed, for reducing itching of the skin, after it has come in contact with said compositions.

9 Claims, No Drawings

BLEACHING COMPOSITIONS

TECHNICAL FIELD

The present invention relates to a liquid bleaching composition comprising a peroxide bleach. The compositions are useful for a variety of applications. The compositions are formulated so as to avoid itching of the skin of the user using the composition, when it comes in contact with the composition.

BACKGROUND

Bleaching with peroxygen bleaches is well known in the art. Peroxygen bleaching finds a variety of applications, such as bleaching fabrics or, in the household, treating hard surfaces or carpets. A major drawback of liquid peroxygen bleaches is that they may bleach the skin of the person using the composition and whiten it, if they come in contact with the composition. This whitening is fully reversible, but it also causes temporary itching of the skin.

It is thus an object of the present invention to provide a liquid peroxygen bleach composition which is formulated so as to avoid this temporary itching phenomenon.

In response, it has now been found that the itching can be reduced by adding an effective amount of an anionic surfactant in said liquid peroxygen bleach composition.

SUMMARY OF THE INVENTION

Accordingly, in its broadest sense, the present invention is the use, in a liquid peroxygen bleaching composition, of an anionic surfactant to reduce itching of the skin of the user of said composition, after it has come in contact with said composition.

In a preferred embodiment, the invention is a liquid composition formulated as an emulsion comprising two phases, each phase comprising a nonionic surfactant, said composition comprising a peroxygen bleach in one of said phases and an activator for said bleach in the other phase, said composition further comprising an anionic surfactant.

DETAILED DESCRIPTION OF THE INVENTION

The compositions according to the present invention are aqueous. Accordingly, the compositions according to the present invention comprise from 10% to 95% by weight of the total composition of water, preferably from 30% to 90%, most preferably from 60% to 80%. Deionized water is preferably used.

The compositions according to the present invention are stable aqueous emulsions of nonionic surfactants. By stable emulsion it is meant an emulsion which does not substantially separate into distinct layers, upon standing for at least 2 weeks at 50° C.

Said emulsions of nonionic surfactants comprise at least two nonionic surfactants. In order to form emulsions which are stable said two nonionic surfactants must have different HLB values (hydrophilic lipophilic balance), and preferably the difference in value of the HLBs of said two surfactants is at least 1, preferably at least 3. By appropriately combining at least two of said nonionic surfactants with different HLBs in water, emulsions according to the present invention will be formed.

The advantage of formulating the compositions of the present invention as emulsions is that a stable activated bleaching compositions can be obtained where the bleach is present in the more hydrophilic phase, and the activator for said bleach is present in the other more hydrophobic phase. Such emulsions are described for instance in EP 92 932.

Suitable nonionic surfactants for use herein include alkoxylated fatty alcohols. Indeed, a great variety of such alkoxylated fatty alcohols are commercially available which have very different HLB values. The HLB values of such alkoxylated nonionic surfactants depend essentially on the chain length of the fatty alcohol, the nature of the alkoxylation and the degree of alkoxylation. Hydrophilic nonionic surfactants tend to have a high degree of alkoxylation and a short chain fatty alcohol, while hydrophobic surfactants tend to have a low degree of alkoxylation and a long chain fatty alcohol. Surfactants catalogues are available which list a number of surfactants including nonionics, together with their respective HLB values.

The compositions according to the present invention comprise from 2% to 50% by weight of the total composition of said hydrophilic and hydrophobic nonionic surfactants, preferably from 5% to 40%, most preferably from 8% to 30%.

The compositions according to the present invention may further comprise other nonionic surfactants which should however not significantly alter the weighted average HLB value of the overall composition.

As an essential ingredient, the compositions herein comprise a peroxygen bleach. Suitable peroxygen bleaches for use herein are water soluble peroxygen bleach. Preferred for use herein is hydrogen peroxide, or water-soluble sources thereof such as perborates, percarbonates, persilicates and persulfate salts.

Hydrogen peroxide is most preferred for use in the compositions according to the present invention. Typically, the compositions according to the present invention comprise from 0.5% to 20% by weight of the total composition of hydrogen peroxide, preferably from 2% to 15%, most preferably from 3% to 10%.

By bleach activator, it is meant herein any compound which reacts with hydrogen peroxide to form a peracid. In the case of bleach activators, such hydrophobic bleach activators typically belong to the class of esters, amides, imides, or anhydrides.

Suitable other activators herein must be hydrophobic in the sense that they will allow segregating said peroxygen bleach in a hydrophilic phase and said bleach activator in a hydrophobic phase.

A particular family of bleach activators of interest in the present invention were disclosed in applicant's co-pending European patent application No 91870207.7. Particularly preferred in that family is acetyl triethyl citrate which was also disclosed in the context of bar soaps in FR 2 362 210. Acetyl triethyl citrate has the advantages that it is environmentally friendly as it eventually degrades into citric acid and alcohol. Furthermore, acetyl triethyl citrate has a good hydrolytical stability in the product upon storage and it is an efficient bleach activator. As used herein and unless otherwise specified, the term bleach activator includes mixtures of bleach activators.

The bleach activators herein cannot be a compound according to the formulae (i)

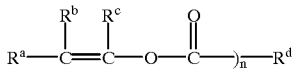

-continued (ii)

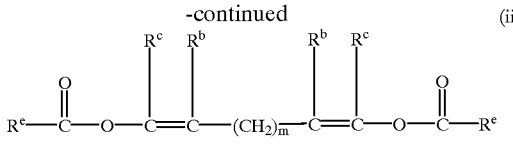

in which each of $R^a$ and $R^b$ represent hydrogen or a $C_1$ to a $C_5$ alkyl radical or a $C_2$ to $C_4$ alkenyl radical or a phenyl radical, $R^a$ and $R^b$ being the same or different or combining together to form a carbocyclic di-radical, $R^c$ represents hydrogen or a $C_1$ to $C_5$ alkyl radical or a phenyl radical or is combined with $R^a$ or $R^b$ and the olefin group to form a carbocyclic radical, $R^e$ represents hydrogen or a $C_1$ to $C_3$ alkyl radical or a phenyl radical, n is 1 or 2, when n=1, $R^d$ represents hydrogen or a $C_1$ to $C_3$ alkyl radical or a phenyl radical, when n=2, $R^d$ represents a $C_2$ to $C_{10}$ alkylene di-radical or a phenylene di-radical, and m is an integer from 0 to 8, or being one of the corresponding compounds to those in formula (i) when n=2 or formula (ii) in which only one of the two enol groups or carboxylic acid groups, as the case may be, is esterified.

Formulating the compositions according to the present invention in an acidic pH range contributes to the stability of the composition. The compositions of the present invention accordingly have a pH as is of from 0.5 to 6, preferably of from 1 to 5. The pH of the composition can be trimmed by all means available to the man skilled in the art.

As discussed hereinafter, when a liquid peroxygen bleach comes in contact with the skin of the person using it, it causes the itching of the skin. After a while, and even if the skin is rinsed there develops an irritation of the skin (herein referred to as itching) which is believed to be caused by the adsorption of the bleach on the user's skin. This adsorption is believed to be induced by the prior adsorption of the nonionic surfactants herein on the skin.

The finding underlying the present invention is that anionic surfactants will reduce or even eliminate the itching which is caused by contact of the bleaching composition with the skin of the user of the composition. Accordingly, the compositions herein comprise an anionic surfactant, or mixtures thereof. Suitable anionic surfactants for use herein include alkyl sulfates, alkyl alkoxylated sulfates and others.

Suitable alkyl sulfate surfactants for use herein are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Suitable alkyl alkoxylated sulfate surfactants for use herein are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyT, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred surfactants for use in the compositions herein are the alkyl benzene sulfonates, alkyl sulfates, alkyl alkoxylated sulfates, and mixtures thereof.

In order to provide the desired benefit of reducing skin itching, we have found that the anionic surfactant, or mixtures thereof should be present in a weight ratio of total anionic surfactant to total peroxygen bleach of from 1 to 10, preferably from 1 to 5, most preferably from 1 to 3. It is believed that this benefit of reducing skin itching is due to the formation of liquid crystals that limit the adsorption of the nonionic surfactant on the skin, and as a consequence, adsorption of the bleach.

Another surprising benefit obtained from the presence of anionic surfactants is that they act as rheology modifyer in the emulsions according to the present invention. Indeed, adding anionic surfactants increases the viscosity of the composition and that is desirable for several reasons, including control of pouring, control for spreading for instance when the composition is used as a laundry pretreater, cling on vertical surfaces, when the composition is used as a hard surface treating composition.

However, adding anionic surfactants above a critical value which depends on the specific system used leads to phase separation and viscosity collapse. We have found that this viscosity building effect of anionic surfactants herein also enhances the stability of the present emulsions at higher temperatures (e.g. above 50° C.). Generally, the compositions herein comprise at most 10% of anionic surfactant.

The compositions according to the present invention may further comprise a variety of the ingredients such as perfumes, dyes, optical brighteners, builders and chelants, pigments, enzymes, dye transfer inhibitors, solvents, buffering agents, radical scavengers and the like.

The composition according to the present invention are particularly suitable as laundry pretreaters, carpet cleaners, or laundry bleach additives. In fact, it appears that the addition of anionic surfactants improves absorbance of the compositions of invention on the fibres. This does not improve pretreatment performance, but gives significant through the wash performance improvement, particularly on whiteness, dingy cleaning and enzymatic stain removal.

In its broadest sense, however, the present invention is not limited to the emulsions compositions of the present invention. Accordingly, the present invention also encompasses the use of an anionic surfactant, in a liquid peroxygen bleach composition, to reduce itching of the skin of the user of said compositions when it comes in contact with said composition.

The present invention further encompasses a process for the manufacture of the composition described herein. The process according to the present invention comprises at least three steps:

In the first step, a hydrophobic mixture is prepared which comprises the most hydrophobic nonionic surfactant together with other hydrophobic ingredients which are to be formulated in the composition, i.e. the bleach activator and optionally as perfumes, solvents, enzymes, bleach activators and polymers.

In the second step, a hydrophilic mixture is prepared which comprises at least water, the more hydrophilic nonionic surfactant. Said peroxygen bleach dyes, optical brighteners, builders, chelants, hydrogen peroxide and buffering agents. In this second step said peroxygen bleach is preferably added last, after said buffering agent has been added.

Naturally, said first and said second steps can be performed in any order, i.e second step first is also suitable.

In the third step, both of said mixtures are mixed together.

The present invention will be further illustrated by the following examples.

EXAMPLES

The following compositions are made by listing the following ingredients in the listed proportions

| Ingredient | A | B |
|---|---|---|
| Dobanol ® 45-7 | 6.0 | 6.0 |
| Dobanol ® 91-10 | 3.0 | 3.0 |
| Dobanol ® 23-2 | 6.0 | 6.0 |
| Alkyl sulfate | 2.0 | 2.0 |
| Hydrogen peroxide | 6.0 | 7.5 |
| Acety triethy citrate | 3.5 | 7.0 |
| Citric acid | up to pH 4.0 | up to pH 4.0 |
| Minors and deionized water | balance | balance |
| viscosity 20° C., 50 rpm) | 700–900 cps | 700–900 cps |

| Ingredient | C | D |
|---|---|---|
| Dobanol ® 45-7 | 8.0 | 6.7 |
| Luthensol ® TO3 | 7.0 | 8.3 |
| Na Alkyl sulfate | 2.0 | 2.0 |
| Hydrogen peroxide | 6.0 | 7.5 |
| Acety triethy citrate | 3.5 | 7.0 |
| Citric acid | up to pH 4.0 | up to pH 4.0 |
| Minors and deionized water | balance | balance |
| viscosity 20° C., 50 rpm) | 1000 cps | 2000 cps |

Furthermore, a test was conducted on 80 panelists to evaluate the skin itching reduction phenomenon. The panelists were asked to use composition C, with and without Na alkyl sulfate, as a stain pretreater on fabrics. The panelists therefore used the product rubbing or spreading it with their fingers. They were asked whether they noticed the skin itching problem.

The following results were observed:

| Panelist Base: 80 | composition without NaAS % | composition with 2% NaAS % |
|---|---|---|
| Noticed skin itching when using the product | 41 | 22 |
| Claimed do not like the product because it causes skin itching | 18 | 11 |

Also, the viscosity building effect of anionic surfactants was evaluated by measuring the viscosity as a function of the amount of anionic surfactant present in the composition. The following results were observed:

| | Composition C without NaAS | Composition C with 1.0% NaAS | Composition C with 2.0% NaAS | Composition C with 3.0% NaAS |
|---|---|---|---|---|
| viscosity (cps) at 20° C. at 50 rpm | 800 | 3700 | 5000 | viscosity collapses with phase separation after 24 hrs at room temperature |
| viscosity (cps) at 20° C. at 3 rpm | 8000 | 47000 | 65000 | viscosity collapses with phase separation after 24 hrs at room temperature |

What is claimed is:

1. A method of bleach pretreatment of fabrics by hand with a peroxygen bleaching composition wherein the itching effect of peroxygen bleach on skin is reduced, the said method comprising the step of rubbing or spreading onto the fabric, with the fingers, a liquid peroxygen bleaching composition which is formulated as an emulsion comprising two phases, each phase comprising a nonionic surfactant, said composition comprising said peroxygen bleach in one of the phases, and an activator for said bleach in the other phase, with the proviso that said activator is not a compound according to the formula.

(i)

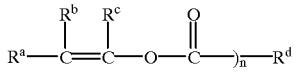

(ii)

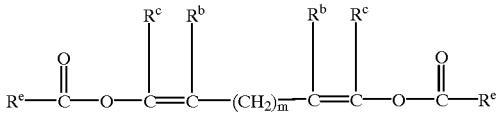

in which each of $R^a$ and $R^b$ represent hydrogen or a $C_1$ to a $C_5$ alkyl radical or a $C_2$ to $C_4$ alkenyl radical or a phenyl radical, $R^a$ and $R^b$ being the same or different or combining together to form a carbocyclic di-radical, $R^c$ represents hydrogen or a $C_1$ to $C_5$ alkyl radical or a phenyl radical or is combined with $R^a$ or $R^b$ and the olefin group to form a carboxyclic radical, $R^e$ represents hydrogen or a $C_1$ to $C_3$ alkyl radical or a phenyl radical, n is 1 or 2, when n=1, $R^d$ represents hydrogen or a $C_1$ to $C_3$ alkyl radical or a phenyl radical, when n=2, $R^d$ represents a $C_2$ to $C_{10}$ alkylene di-radical or a phenylene di-radical, and m is an integer from 0 to 8, or being one of the corresponding compounds to those in formula (i) when n=2 or formula (ii) in which only one of the two enol groups or carboxylic acid groups, as the case may be, is esterified, said composition further comprising an anionic surfactant wherein the ratio of said anionic surfactant to total peroxygen bleach is from 1 to 10, with the proviso that the said anionic surfactant be present in an amount less than that which will cause viscosity loss and phase separation.

2. The method of claim 1 where said peroxygen bleach is hydrogen peroxide.

3. The method of claim 2 where said hydrogen peroxide is present in an amount of from 0.5% to about 20% by weight of the total composition.

4. The method of claim 3 where said hydrogen peroxide is present in an amount of from about 2% to about 15% by weight of the total composition.

5. The method of claim 4 where said hydrogen peroxide is present in an amount of from about 3% to about 10% by weight of the total composition.

6. The method of claim 1 where said anionic surfactant and said peroxygen bleach are present in a weight ratio of from 1 to about 5.

7. The method of claim 6 where said anionic surfactant and said peroxygen bleach are present in a weight ratio of from about 1 to about 3.

8. The method of claim 1 where said anionic surfactant is present in an amount of at most 10% by weight of the total composition.

9. The method of any of one of claims 1 to 8 wherein said anionic surfactant is an alkyl benzene sulfonate or an alkyl sulfate.

* * * * *